US009457923B2

(12) United States Patent
Lam

(10) Patent No.: US 9,457,923 B2
(45) Date of Patent: Oct. 4, 2016

(54) TAPE APPLICATOR TAB LENGTH CONTROL

(71) Applicant: LAMUS ENTERPRISES INC., Vancouver (CA)

(72) Inventor: Joe Augustine S. T. Lam, Vancouver (CA)

(73) Assignee: LAMUS ENTERPRISES INC., Vancouver, BC (CA)

( * ) Notice: Subject to any disclaimer, the term of this patent is extended or adjusted under 35 U.S.C. 154(b) by 0 days.

(21) Appl. No.: 14/510,207

(22) Filed: Oct. 9, 2014

(65) Prior Publication Data

US 2016/0101960 A1 Apr. 14, 2016

(51) Int. Cl.

| | |
|---|---|
| ***B65H 26/00*** | (2006.01) |
| ***B32B 38/10*** | (2006.01) |
| ***G05G 15/00*** | (2006.01) |
| ***B29C 70/34*** | (2006.01) |
| ***B65B 51/06*** | (2006.01) |
| ***B65H 23/14*** | (2006.01) |
| ***B65H 23/16*** | (2006.01) |
| ***B65H 23/08*** | (2006.01) |
| ***B65H 35/00*** | (2006.01) |
| *B65H 23/10* | (2006.01) |

(52) U.S. Cl.

CPC ..... *B65B 51/067* (2013.01); *B65H 23/08* (2013.01); *B65H 23/14* (2013.01); *B65H 23/16* (2013.01); *B65H 35/0013* (2013.01); *B65H 35/0033* (2013.01); *B65H 23/10* (2013.01); *B65H 2402/31* (2013.01); *B65H 2402/32* (2013.01); *B65H 2402/542* (2013.01); *B65H 2701/18483* (2013.01); *B65H 2701/1944* (2013.01)

(58) Field of Classification Search

CPC ..... B65H 37/02; B65H 35/0013; B65H 35/0033; B65H 2402/31; B65H 2402/32; B65H 51/067; B65H 23/08; B65H 23/14; B65H 23/16

See application file for complete search history.

(56) References Cited

U.S. PATENT DOCUMENTS

| | | | | |
|---|---|---|---|---|
| 4,592,188 | A | 6/1986 | Marchetti | |
| 4,855,006 | A * | 8/1989 | Marchetti | B65B 51/067 156/352 |
| 4,980,011 | A * | 12/1990 | Gruber | B65H 35/0013 156/238 |
| 5,676,298 | A * | 10/1997 | Shing-Tak Lam | B65H 35/0013 226/190 |
| 7,493,741 | B1 * | 2/2009 | Chiu Chen | B65B 51/067 156/468 |
| 7,665,498 | B2 * | 2/2010 | Bredl | B65B 51/067 156/351 |
| 8,176,959 | B2 | 5/2012 | Lam | |
| 8,327,902 | B2 | 12/2012 | Lam | |
| 2012/0097334 | A1 * | 4/2012 | Lam | B31D 1/0062 156/350 |
| 2012/0232699 | A1 | 9/2012 | Menta et al. | |

FOREIGN PATENT DOCUMENTS

| | | |
|---|---|---|
| GB | 2506998 A | 4/2014 |
| WO | 0202411 A1 | 1/2002 |

OTHER PUBLICATIONS

Search report for corresponding application No. GB 1517032.7, dated Feb. 22, 2016.

* cited by examiner

*Primary Examiner* — Alex Efta

(57) ABSTRACT

Tab length is controlled in a tape applicator by adjusting the position of a tension roll as the diameter or periphery of the tape supply roll is changed to increase the force pulling the tape from the supply roll as the diameter of the tape supply roll decreases without significantly changing the tension in the tape.

5 Claims, 4 Drawing Sheets

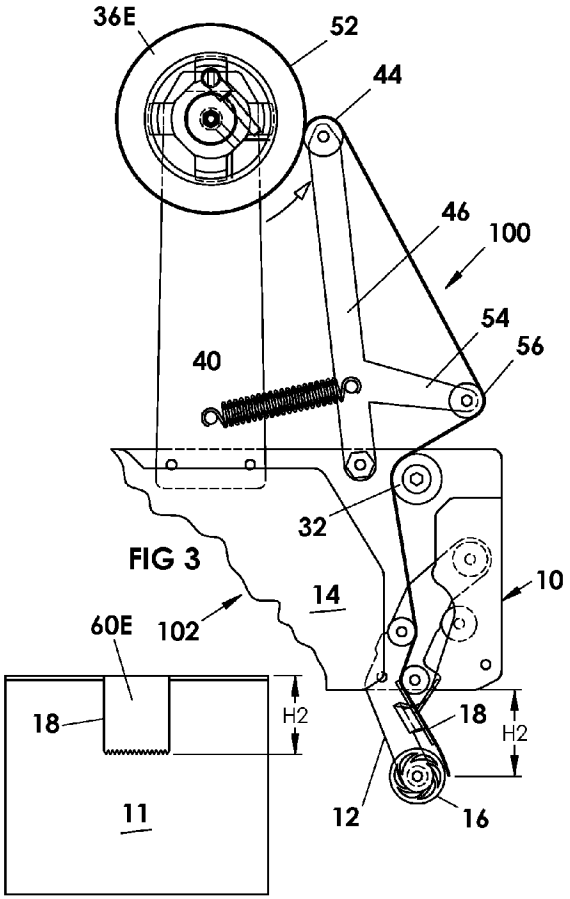
FIG 3
FIG 3a
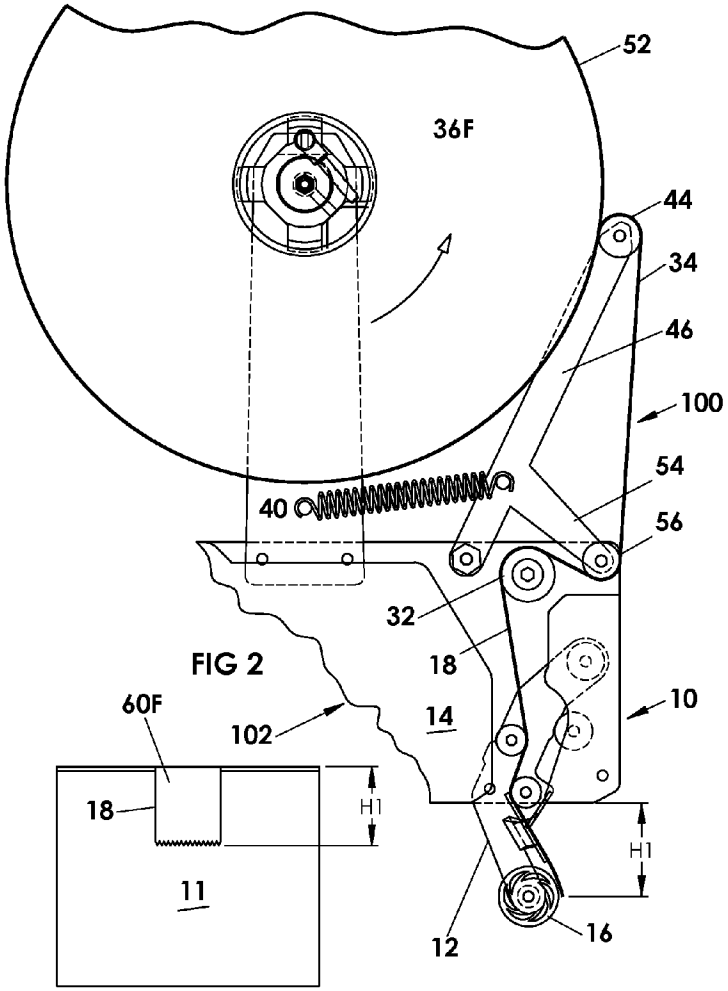
FIG 2
FIG 2a

TAPE APPLICATOR TAB LENGTH CONTROL

FIELD OF INVENTION

The present invention relates to a tape applicator for apply tape to seal a case or carton and particularly to an improved tape tension system to simplify obtaining of a uniform tape tab length.

BACKGROUND OF THE PRESENT INVENTION

In the packaging of goods in containers, such as corrugated cartons or the like, it is common practice to use a tape sealing machine with a tape applicator to apply a strip of sealing tape along one end, across the top (or bottom) generally formed by a pair of opposed flaps and along another end of such a container. The adhesive tape is usually of Bi-axially Oriented Poly-Propylene (BOPP) film with an adhesive layer on one side and a release coating on the other side for ease of unwind. To properly seal the flaps of the carton in order to provide sufficient holding force to the carton, The adhesive tape normally applied first to the one end which in most machines forms a vertical surface, from this vertical surface of the carton, across the horizontal surface formed by the pair of opposed flaps to the other end of the carton which normally is a second vertical surface so the shoulders or the corners of the carton formed at the intersections of the vertical and horizontal surfaces are tightly wrapped. The vertical portions of the tape on each of the ends or the carton are each referred to as a tape tab. The length of the tab is preset by the tape applicator to provide a desirable amount of adhesive holding force to the carton. The tab length is usually preset from 2" to 2.5", excessive tab length is costly and un-effective, inadequate tab length reduces the adhesive area and holding force to the carton and causes a defective package.

The tape applicator automatically applies and cut off the tape to seal each carton as the carton advances passed the tape applicator usually by being carried on a conveyor of the packaging machine. The tape is supplied from a tape roll mounted on the packaging machine frame or usually mounted on the frame of the applicator which forms part of the machine.

As is well known a proper tape application system involves the source of tape, tape delivery; tape applying, tape cutting, and tape wipe down.

Most major problems encountered in carton taping using a conventional tape applicator are related to the tape tension as follows:

(1) Low tension:

Results in loose and wrinkled tape on carton; tape not cutting properly; extended tape tabs (2) High tension:

Results in the tape being over-stretched and elongated causing the tape to shrink and pull back; premature tape cutting; tape flagging; tape snap back and crumple; shortened tape tab lengths There are two manual tension adjustments in a conventional tape applicator, namely (1) mandrel tension control, (2) clutch roller tension control which can partially address the abovementioned tension related issues and the variable unwinding (peel-off) force from the tape dues to different adhesive formula (hot melt, acrylic or rubber); release coating; width of tape (2" or 3"); application temperature; etc. A third tension adjustment (3) may be provided by an added-on attachment in the form of a nip roller mounted at the free end of a dancer arm and biased against the periphery of the tape roll, (1) Tape Mandrel Tension Adjustment:

The mandrel tension adjustment normally consists of a hub to hold the hub of the tape roll, rotatable on a shaft with friction washers, compression spring and adjusting knob as a mean to provide a rotational drag on the tape roll as the tape being dispensed. It is the first stage of tape tension control and is applied at the source of tape supply, and functions to prevent the tape roll from free spinning; over-spinning or tape over-stretching. The amount of tension adjustment is also based on the unwinding force required for the tape being used, for example: low tension setting for sticky or wider tape, higher tension setting for narrower width and tape with a release coating.

In carton sealing, the carton are being deliver in space sequence one by one, requiring the tape to be pulled from the tape roll intermediately. The tape roll rotation starts and stops at every taping cycle, it tends to over-spin every stop cycle after tape cutting. Over-spin of tape roll creates loose tape, which affects the tape cutting (tape un-cut or cut with extended tab length) as well as taping consistence in the following taping cycle.

More rotational drag is required to reduce the over-spinning, particularly when tape is being drawn from a new roll of tape with a large diameter (15") due to the additional mass and inertia.

If the drag applied at the tape mandrel is too high it will normally lead to tape breakage; stretched and elongated tape; premature tape cutting; tab crumpling and/or shortened tabs.

(2) Clutch Roller Tension Adjustment:

Generally the tension adjustment mechanism used in the clutch roll is similar to the mandrel tension adjustment mechanism using a compression spring; friction washers and an adjusting knob to adjust rotational drag. The clutch roller also is provided with a one-way clutch bearing to permit the tape to advance toward an applicator roll that applies the leading end of the tape to the carton while preventing the tape travel in reverse direction i.e. back toward the tape roll. The clutch roller's surface is knurled to release the adhesion of the tape.

The tension control at the tape roll mandrel is in essence the farthest from the point of application of the tape to the carton and provides a first stage of tension control applied to the tape. The clutch roller is the second stage of tape tension control of the tape and is positioned on the tape path from the tape roll to the applicator roll at an intermediate location between the tape roll and applicator roll. The clutch roller provides a secondary tension control to supplement the tension adjustment of the tape roll mandrel. Its position is closer to the point of application and tape cutting, its tension adjustment affects proper tape cutting, taping quality and tends to stabilize the tape for the tape application cycle.

Similar to the tape roll mandrel adjustment, low tension setting on the clutch roller leads to loosely adhered wrinkled tape on the carton; tape not being properly cut or tape an extended tab length. High tension setting leads to stretched tape on the carton which shrinks and causes the tabs to pull backwards; tape breakage; tape cut prematurely; tape crumple; and/or the tape to snap away from the application roller; and/or generate a shortened length tab.

(3) A nip roller dancer arm

A nip roller at the free end of a dancer arm tends to stabilize the tape tension at the tape source. The dancer arm is spring bias to [press the nip roller against the circumference of the tape roll, the nip roller governs the position of tape being peeled off from the tape roll. The round surface of the roller supports the tape as it peels off the tape roll as the tape roll unwinds and provides a smoother tape release thereby to minimize jerky movement of the tape which may cause tape breakages.

It is believed that all tape applicators on the market are equipped with the above mentioned two manual tension adjustments and some may also include the nip roller dancer arm. Generally the tape tension is adjusted to a desirable level based the type of tape being used before startup of the machine in order to provide a reliable tape closure. However, it is well known that the tape's tension changes as the tape is being applied. Specifically, the tape tension increases gradually as the tape roll is depleted from a new roll (Max. 15" diameter) down to a smaller roll (Min. 3.3" diameter) during the tape sealing operation. The increased tape tension leads to tape breakages, tape shrinkage, premature tape cut, tape not being applied due to snap back or shortened tab length etc. creating batches of defective packaged cartons. All these problems appear mostly after the tape roll has been depleted down to approximately 4" to 5" diameter. To avoid these problems, there are three common practices in the industry (1) Monitor the tape roll, re-adjust the tension control manually once or twice based on the remaining size of the tape roll. (2) Install a new tape roll and discard the remaining tape roll before the tape is fully depleted. (3) Use an over-graded thicker tape which can sustain a higher tension, allow an over-extended tab length in the initial low tension setting for new roll to compensate the increases of tape tension which shortens the tab length as the tape is depleting. (This approach resolved some of the problem but it also leads to the problem of cutting a thicker tape with low tension). All three approaches are not ideally effective and generally result in added production down time, waste of tape and increase cost of tape, etc.

The currently available tension controls and the add-on nip roller dancer arm in a conventional tape applicator can only be preset to accommodate a constant condition such as tape peel-off unwind force and resistance through the tape path etc., they are not sufficient to control the changing tape tension as occurs during the taping operation i.e. as the tape is being dispense and the diameter of the tape roll changes when the tape roll goes from a large roll to a smaller roll. The changes of tension originate mainly from the drag preset at the tape mandrel.

A simple example illustrates how the changes of tape roll size affect the changes of tape tension: A new roll of tape with a 15" diameter dispenses 24" long tape on a 20" long carton rotates ½ revolutions to complete one taping cycle. On the other hand when the tape roll has depleted gradually down to a 3.5" diameter tape roll, it must now rotate 2 revolutions to dispense the same 24" long tape for the same 20" long carton. The tape tension increase significantly dispensing the same length of tape from the smaller roll since it has to overcome the additional rotations with the rotational drag initially preset to rotate for ½ revolutions.

Tape applicators as generally used to apply tapes to seal a carton operate by providing a leading tape which is wiped onto the leading face of a carton or case being sealed and secured thereto and then is applied over the adjacent edge of the case and along the top (or bottom of the case. The length of tape applied to the leading face of the case or carton i.e. extending from the adjacent edge to the adjacent end of the tape is normally referred to as the tab and the length of this tab in conventional machines changes significantly unless in the case of conventional machines the tape tension is adjusted as the diameter of the tape roll from which the tape is being drawn changes. Tension adjustment systems of the prior art as described above are not done on the fly and in any event do not generally provide adequate control to maintain the tab length reasonably constant as the diameter of the tape roll changes. The present invention provides a mechanism that maintains the tab length about the same length as the diameter of the tape roll changes.

The convention tape applicators as above indicated generally direct tape from the tape roll to an entry roll from which the tape passes onto a one way clutch roll and from there to a front applicator roll that applies the leading end of the case being sealed. It is known to provide a dancer arm with a nip roll at its free end and to lead the tape over the nip roll which is pressed against the periphery of the tape roll and facilitate peeling of the tape off the tape roll; see for example U.S. Pat. No. 4,592,188 issued Jun. 3, 1986 to Marchetti.

It is also known to provide slack in the tape between the clutch roll and the tape roll by replacing a fixed entry roll as commonly used with an entry roll that is mounted on the free end of a dancer arm that reciprocates the entry roll between a position adjacent to and a second position spaced farther from the clutch roll at the appropriate time in the taping cycle to generate slack in the tape between the tape roll and the clutch roll; see U.S. Pat. No. 8,327,902 issued Dec. 12, 2012 to Lam.

U.S. Pat. No. 8,176,959 issued May 15, 2012 to Lam teaches a multi-purpose machine that may be converted to apply tape as a conventional C-clip where the tape extends generally up one side of a case across the top (or bottom) and the down the side of the case opposite the one side or an L-clip where the tape extends up one side around a corner at the top (or bottom) of the case and then part way along the top (or bottom) of the case. The patent shows the clutch roll and inlet roll both mounted in fixed relationship on a dancer arm to accommodate movement of the front applicator arm and roll to an over travel position when L-clips are to be applied.

BRIEF DESCRIPTION OF THE PRESENT INVENTION

It is an object of the present invention to provide an improved tape applicator where tab length is better controlled.

Broadly the present invention relates to a tape applicator for applying a sealing tape to a carton, said tape applicator having a frame, a tape roll mounting having a hub on which a roll of tape to be applied to seal said case may be mounted, a tape path between a periphery of said roll of tape and a tape applicator roll positioned to apply tape to said case as said case is moved relative thereto, rolls defining said tape path, one of said rolls being a one way clutch roll to permit tape movement toward said tape applicator roll and inhibiting tape movement in the opposite direction, a dancer arm pivotably mounted adjacent to one end of said dancer arm on said frame and a nip roller mounted on said dancer arm adjacent to an end of said dancer arm remote from to said one end, means biasing said dancer arm to press said nip roller into contact with said periphery of said roll of tape, said nip roller defining an initial portion of said tape path, the improvement comprising;

a tab length control comprising a tension roll coupled to said dancer arm and defining a portion of said tape path between said nip roller and said one way clutch roller, said tension roll being coupled to said dancer arm so that as said dancer roll moves toward said tape mounting as said roll of tape is being depleted said tension roll moves relative to said clutch roller thereby changing said tape path to adjust the forces applied at said nip roller as said periphery of said tape roll decreases.

Preferably said tension roll is mounted adjacent to a free end of an auxiliary mounting arm that is directly connected to said dancer arm.

Preferably said tension roll is mounted on a lever arm that is pivotably mounted on said frame and means is provided to bias a camming projection of said lever arm against said dancer arm so that said tension roll moves with said dancer arm and in accordance with the interaction of said camming projection with said dancer arm.

Preferably means are provided to adjust the position of said tension roll relative to said dancer arm.

Preferably said tab length control is positioned remote from said tape applicator.

BRIEF DESCRIPTION OF THE SEVERAL VIEWS OF THE DRAWINGS

Further features, objects and advantages will be evident from the following detailed description of the preferred embodiments of the present invention taken in conjunction with the accompanying drawings in which;

FIG. 2 is a schematic illustration with parts omitted for clarity of FIG. 1 embodiment of the present invention illustrating the tape path when tape is being dispensed from a full roll of tape FIG. 2*a* is a schematic illustration of the tab length generated when tape is being dispensed from a full roll of tape using the present invention as shown in FIG. 1.

FIG. 3 is a schematic illustration of embodiment of the present invention shown in FIG. 1 illustrating the tape path when tape is being dispensed from an almost depleted roll of tape.

FIG. 3*a* is a schematic illustration of the tab length generated when tape is being dispensed from an almost depleted roll of tape using the present invention as shown in FIG. 1.

DETAILED DESCRIPTION OF THE INVENTION

Figure 1:
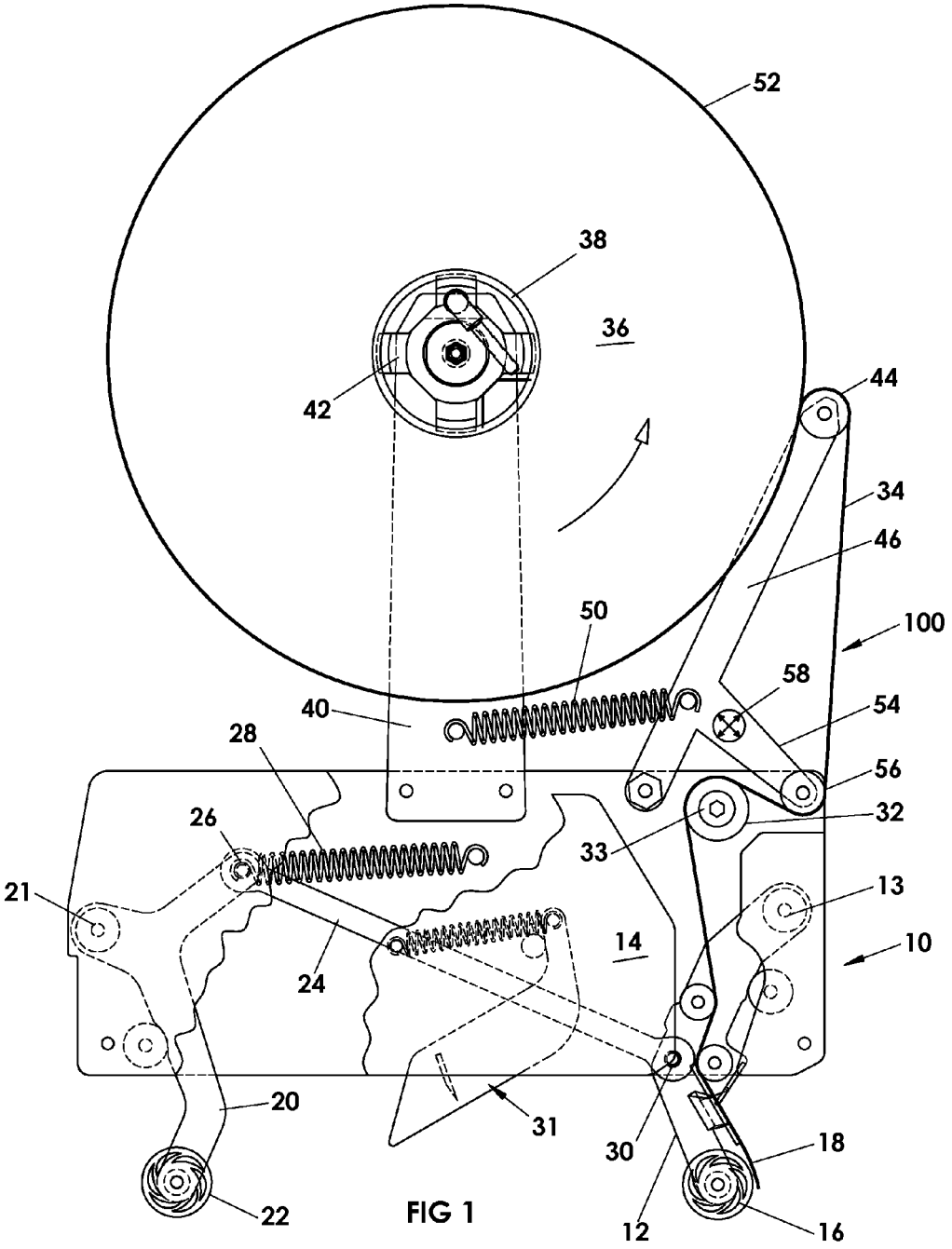
FIG. 1 is a schematic illustration of one form of the present invention as applied to a conventional or well known tape applicator showing the applicator in more detail than in the subsequent views.

Attention is directed to FIG. 1 which illustrates the preferred form of the present invention as applied to a tape applicator 10 for applying sealing tapes to cartons 11 (FIG. 2*a* or 3*a*). As shown the tape applicator 10 has a conventional front applicator arm 12 pivotably mounted to the frame 14 as indicated at 13 and carrying an applicator roll 16 adjacent to its free end. The applicator roll 16 presses the adhesive side of a tape 18 being used to seal a case or carton 11 against the approaching face of the carton 11. As is known the applicator roll or roller 16 may be replaced by wipers or applicators of various forms but a roll is preferred and the use of the term applicator roll or roller is not to be interpreted as excluding these other devices. The applicator 10 as is normal the case also includes the rear wiper arm 20 pivotably mounted on the frame 14 as indicated at 21 and having a wipe down roll or the like 22 at one side of the mounting 21 and connected to a push rod 24 on the opposite side of the mounting 21 as indicated at 26. Also connect at 26 to the rear arm 20 is a spring 28 that in the illustrated arrangement biases the arm 20 to rotate clockwise around the pivotal mounting 21. The push rod 24 interconnects with the front applicator arm 12 as indicated at 30 so that the spring 28 urges the arm 12 to the starting position as shown in FIG. 1.

A suitable cut-off mechanism 31 is mounted on the frame 14 to function in the normal manner.

A one-way clutch roll 32 is rotatably mounted on the frame 14 and forms part of the tape path 34 which will be described in more detail below. This one-way roll 32 is equipped with an adjustable drag applying mechanism and one way clutch mechanism as indicated schematically at 33 and is generally used to apply added drag to the tape 18 and to permit the tape 18 to travel only in the direction of the applicator roll 16.

A roll of tape 36 from which the tape 18 is drawn in operation is mounted on a hub 38 which in turn is mounted to a mast 40 extending from the frame 14. The hub mounts the roll 36 in the normal manner and is provided with a conventional adjustable drag applying mechanism as schematically indicated at 42.

The tape 18 is withdrawn from the tape roll 36 by passing around a nip roll 44 which is rotatably mounted adjacent to the free end of a dancer arm 46 pivotably mounted on the frame 14 as indicated at 48. The dancer arm 46 is biased by spring 50 extending between the arm 46 and the mast 40 to press the nip roll 44 against the periphery 52 of the roll 36.

The apparatus described above is found in many tape heads currently in use.

The present invention provides a tab length control 100 which in the embodiment shown in FIG. 1 is directly connected to the rape applying portion 102 of the tape applicator 10. In the embodiment of FIG. 1 the tab length control 100 incorporates a dancer arm 46 having an auxiliary mounting arm 54 projecting laterally there from in a direction away from the roll 36. The arm 54 mounts a tension roll 56 adjacent its free end. As indicated schematically by the reversible mutually perpendicular arrows 58 (which is optional) the position of the auxiliary arm 58 relative to the dancer arm 46 may be changed e.g. along and/or projecting from the dancer arm 46 i.e. may be made adjustable if desired so that the position the roll 56 may be adjusted as desired to facilitate accommodation of tapes with different characteristics by changing the relationship of roll 56 to the arm 46 which will change the positioning of the roll along the tape path 34.

With the present invention the tape path 34 extends from the periphery 52 of the tape roll 36 about the nip roll 44 then over the tension roll 56 then the one-way clutch roll 32 and from there to the applicator roll 16. It will be apparent that this path 34 changes as the tape roll 36 is depleted from the full roll 36F in FIG. 2 to the depleted or almost empty roll 36E shown in FIG. 3. In the illustration of FIGS. 2 and 3 as shown in FIG. 2 with the full roll 36F the wrap of the tape 18 around the periphery tension roll 56 (contact between) extends for about 120° and the wrap of the tape 18 around the clutch roll is about 125° degrees i.e. with dancer arm 46 positioned to the far right in the illustration by contact of the nip roll 44 with the periphery 52 of the full roll 36F. As the tape roll 36 is diminished the tension roll 54 is moved relative to the clutch roll 32 around the axis defined by the mounting 48 of the dancer arm 46 to the frame 14 to the depleted or empty roll 36E position shown in FIG. 3. In the full roll 36F position the span between the tension roll 56 and roll 44 as a percentage of the total span between the rolls 44 and 32 is less than it is when in the empty roll 36E position. When the dancer arm 46 reaches the position shown in FIG. 3 the wrap around the tension roll 54 has been reduce to about 90° and the warp around the clutch roller 32 to about 70°. In the depleted roll position of FIG. 3 a higher percentage of the forces applied by the tension in the tape 18 are applied at the nip roll 44.

As above described as the tape roll 36 is depleted and the size (diameter) of the roll 36 gradually reduces as the tape 18 is pulled there from until it reaches the size of the depleted roll 36E shown in FIG. 3. In this position the dancer arm 46 continues to hold the roll 44 against the periphery 52 of the roll 36 and is rotated counter clockwise about axis 48 which changes the wraps around the clutch roll 32 and tension roll 56 as above described by moving the tension roll 52 relative to the one way clutch roll 32. This action gradually increases the force (tension) applied by the tension in the tape 18 at nip roll 44.

It will be apparent that the tension applied to the tape 18 need not change significantly even if the force required to peel the tape 18 from the roll 36 changes provided the distribution of the forces applied by the tension in the tape 18 is adjusted to apply more force at nip roll 44 as the periphery 52 of the roll 36 decreases. Thus tension in the tape 18 may be about the same when the roll 56 is in the FIG. 2 or FIG. 3 positions. In FIG. 2 position of roll 56 less force is applied at nip roll 44 than the force applied at nip roll 44 when the roll 56 is in the FIG. 3 position. Thus when a lower force is required to pull the tape 18 from the tape roll 36 as is the case when the tape 18 is being dispensed from a full or new as shown at 36F in FIG. 2 the percentage of the available force being transmitted by tension in the tape 18 at the nip roll 44 is less. On the other hand when the a higher force is required to pull the tape 18 from the tape roll 36 i.e. when the tape roll 36 is depleted as shown at 36E in FIG. 3 the percentage of the available force being transmitted by tension in the tape 18 at the nip roll 44 is higher. Thus repositioning the tension roll 56 as described above applies more force at the nip roll 44 to pull the tape 18 from the roll when required without significantly changing the tension applied to the tape 18 i.e. the tension as normally required to pull the tape 18 from the empty roll 36E of FIG. 3 In this manner the tension applied to the tape 18 is maintained more uniform and as result as shown in FIGS. 2*a* and 3*a* the length H1 and H2 of the tabs 60F and 60E are about the same regardless of whether the tape 18 is being pulled from a full tape roll 36F (FIG. 2) or a depleted tape roll 36E (FIG. 3) and the tab length will remain relatively constant as the tape roll 36 is depleted from the size of roll 36F to the size of tape roll 36E.

Figure 5:
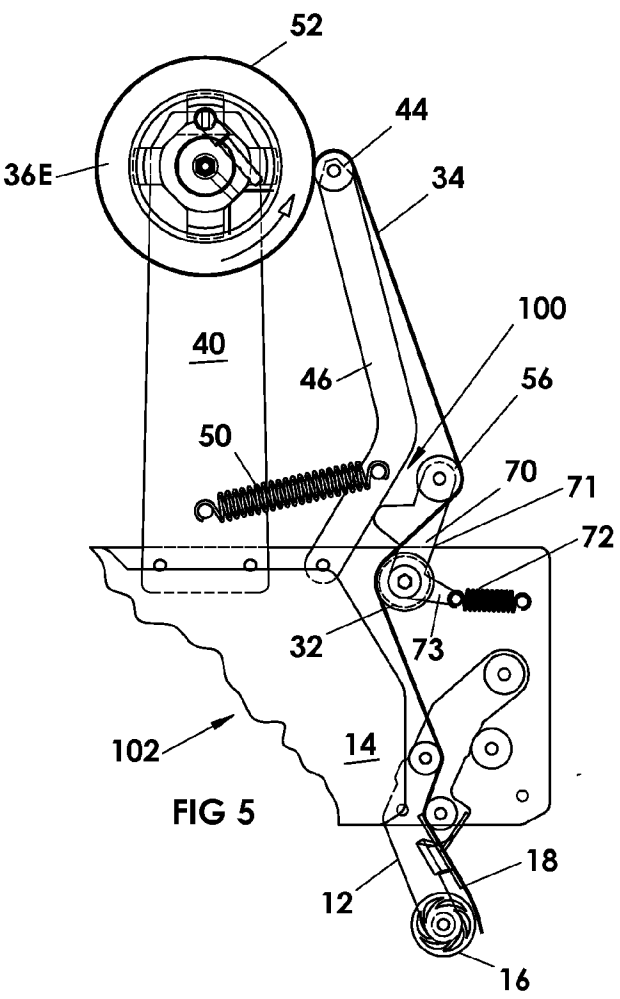
FIG. 5 is a schematic illustration of anther embodiment of the present invention showing the tape path from an almost depleted tape roll.
Figure 4:
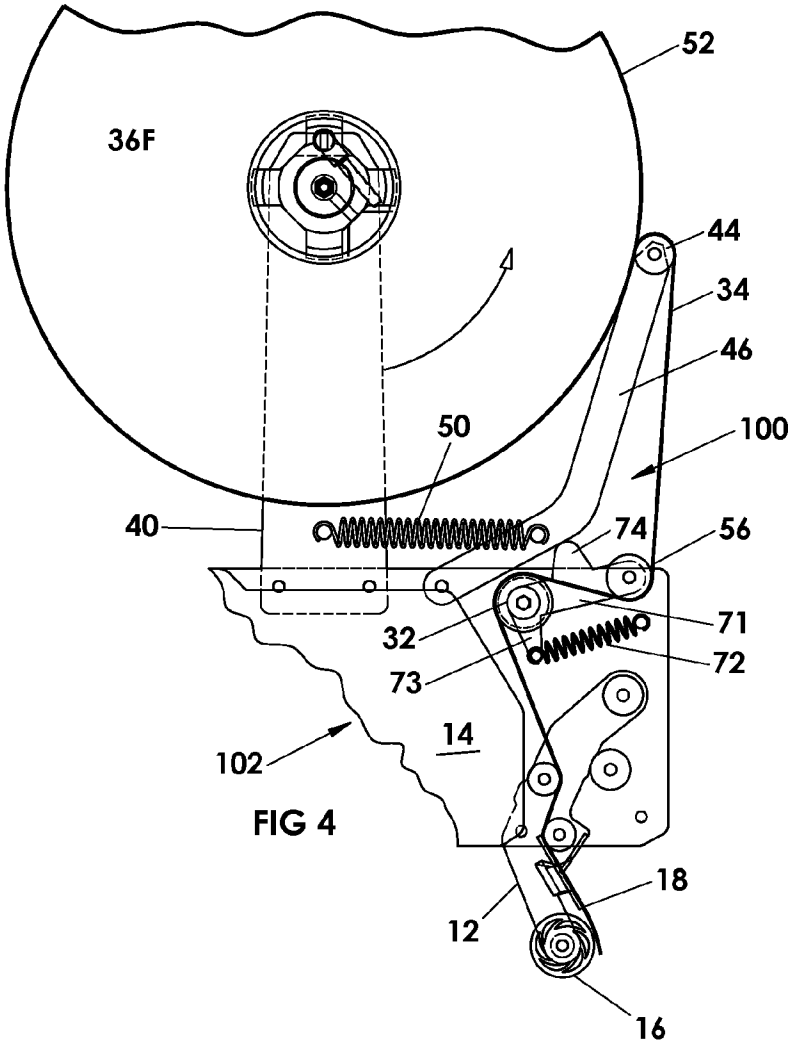
FIG. 4 is a schematic illustration of anther embodiment of the present invention showing the tape path from a full roll.

In the FIGS. 4 and 5 embodiment the auxiliary arm 54 has been replaced with a separate cam arm 70 which is L shaped in the illustrated arrangement and is pivotably mounted to the frame 14 on the same axis as the clutch roll 32. The L shape is provided by its arms 71 and 73 extending from opposite sides of its axis. The arm 70 mounts the tension roll 56 adjacent to the free end of arm 71 which extend on the side of the clutch roll 56 adjacent to the nip roll 44. The arm 70 is biased via spring 72 connected to the other arm 73 to hold a camming projection 74 on the arm 71 against the dancer arm 46 so that the tension roll 56 is repositioned in the same manner and acts in the same manner as described above with reference to FIGS. 2 and 3. The camming projection 74 which interacts with the dancer arm 46 provides a further means to adjust the position of the tension roll 56 as the tape roll is depleted from full 36F to depleted 36E. In this FIG. 6 embodiment the tension roll 56 moves with said dancer arm 46 and in accordance with the interaction of said camming projection 74 with said dancer arm 46. The positioning of the tension roll 56 relative to the dancer arm 46 may be further modified by changing the interaction of the camming projection 74 with the dancer arm 46 i.e. the movement of the tension roll 56 as the tape roll 36 is being depleted may be finer tuned to the tape roll being used.

Figure 6:
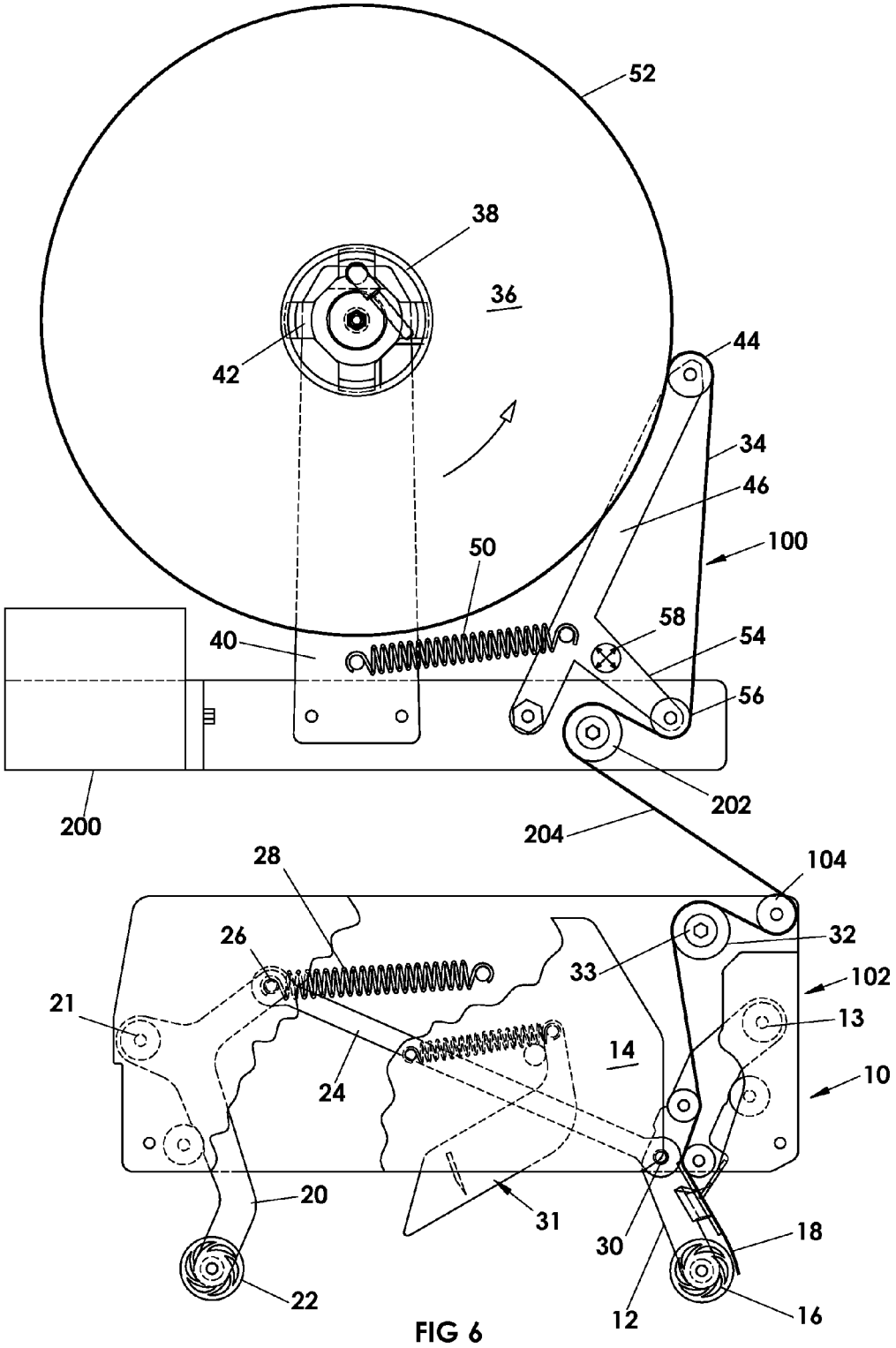
FIG. 6 shows the tape supply and tension positioned remote from the tape applicator.

FIG. 6 shows a further embodiment of the present invention wherein the tension control 100 is positioned remote from the tape applicator 10 normally in some convenient location on the machine frame 200 of the machine with which the applicator 10 is being used. In FIG. 6 like numbers have been used to indicate like parts to those described above. The tension control 100 is essentially the same as that shown in FIGS. 1, 2 and 3 but the embodiment of FIGS. 4 and 5 could equally well be used. The tension control 100 need not be re-described and thus only the differences will be discussed.

The roll 202 mounted on the frame 200 may be a simple roll or may be a clutch roll as described above reference to clutch roll 32 and used to replace or supplement the clutch roll 32 on the applicator 10. If used in conjunction with the clutch roll 32 the drag normally applied by the clutch roll 32 will be shared in any suitable manner between the two clutch rolls 32 and 202. This is the preferred arrangement as it provides for better control of the tape than if it were an ordinary free-wheeling roll. It is preferred that the applicator 10 be left substantially in tacked with the minimum number of changes and thus the clutch roll 32 normally will not be replaced.

In the arrangement illustrated in FIG. 6 an entry roll 104 has been included on the applicator portion 102 so the tape 18 leaving the roll 202 on the modified tape path 204 passes around the entry roll 104 and then to the clutch roll 32 on the applicator 10 for application by the applicator 10 to the case or carton 11.

Having described the invention, modifications will be evident to those skilled in the art without departing from the scope of the invention as defined in the appended claims.

The invention claimed is:

1. A tape applicator for applying a sealing tape to a case, said tape applicator having a frame, a tape roll mounting having a hub on which a roll of tape to be applied to seal said case may be mounted, a tape path between a periphery of said roll of tape and a tape applicator roll positioned to apply tape to said case as said case is moved relative thereto, rolls defining said tape path, one of said rolls being a one way clutch roll to permit tape movement toward said tape applicator roll and inhibiting tape movement in the opposite direction with an adhesive side of said tape contacting said clutch roll, a dancer arm pivotably mounted on said frame adjacent to one end of said dancer arm and a nip roller mounted on said dancer arm adjacent to an end of said dancer arm remote from to said one end, means biasing said dancer arm to press said nip roller into contact with said periphery of said roll of tape, said nip roller defining an initial portion of said tape path, a tab length control comprising a tension roll coupled to said dancer arm and defining a portion of said tape path directly from said nip roller to said one way clutch roll, said tension roll positioned to contact said tape solely on a side of said tape opposite said adhesive side being coupled to said dancer arm so that as said dancer arm moves toward said tape roll mounting as said roll of tape is being depleted said tension roll moves relative to said clutch roll thereby changing said tape path to reduce wrap angles of said tape around said tension roll and said clutch roll.

2. The tape applicator for applying a sealing tape to a carton as defined in claim 1 wherein said tension roll is mounted adjacent to a free end of an auxiliary mounting arm that is directly connected to said dancer arm.

3. The tape applicator for applying a sealing tape to a carton as defined in claim 1 wherein said tension roll is mounted on a lever arm that is pivotably mounted on said frame and means is provided to bias a camming projection of said lever arm against said dancer arm so that said tension roll moves with said dancer arm and in accordance with an interaction of said camming projection with said dancer arm.

4. The tape applicator for applying a sealing tape to a carton as defined in claim 1 wherein means are provided to adjust the position of said tension roll relative to said dancer arm.

5. The tape applicator as defined in claim 1 wherein said tape roll, said dancer arm and said tension roll are located at a location remote from a tape applying portion of said tape applicator.

* * * * *